US005130011A

United States Patent [19]

Sage, Jr.

[11] Patent Number: 5,130,011

[45] Date of Patent: Jul. 14, 1992

[54] CONTACT LENS HOLDER

[76] Inventor: James R. Sage, Jr., 3089 Meadowbrook Ct., Gibsonia, Pa. 15044

[21] Appl. No.: 762,409

[22] Filed: Sep. 19, 1991

[51] Int. Cl.[5] ..... A45C 11/04; B65D 73/00

[52] U.S. Cl. ..... 206/5.1; 206/457

[58] Field of Search ..... 206/5.1, 457

[56] References Cited

U.S. PATENT DOCUMENTS 3,070,105 12/1962 Brown ..... 206/5.1

3,253,702 5/1966 Ray ..... 206/5.1

3,519,005 7/1970 Krezanoski et al. ..... 206/5.1

*Primary Examiner*—William I. Price

*Attorney, Agent, or Firm*—Ansel M. Schwartz

[57] ABSTRACT

The present invention pertains to a contact lens holder. The contact lens holder comprises a fixture shaped in the form of a creature having two eye sockets. The contact lens holder is also comprised of at least two containers, each of which hold a contact lens in a liquid solution. The containers are in contact with and disposed in the creature's eye sockets such that the containers represent the creature's eye. In a preferred embodiment, the containers are releasably secured to the fixture.

16 Claims, 3 Drawing Sheets

CONTACT LENS HOLDER

FIELD OF THE INVENTION

The present invention is related to contact lens cases. More specifically, the present invention is related to contact lens cases which are disposed on a fixture.

BACKGROUND OF THE INVENTION

Contact lens cases are a mandatory accessory for any contact lens wearer because when not in use by the wearer, the lens must be stored in a liquid solution until the next usage. Contact lens cases are used frequently enough to justify them as a permanent fixture at an accessible location such as a bathroom sink or the like. Typically, contact lens cases are small, inexpensive containers lacking in stability and inertia, enough so that they are frequently pushed aside inadvertently behind the multitude of cosmetic bottles that invariably collect on a bathroom sink. In fact, almost any contact lens wearer will support the fact that the typical small, nonsubstantial contact lens case never seems to stay put and can be periodically lost.

Accordingly, it is an object of the invention to provide a fixture for holding contact lenses which is stable upon a surface and which is easily locatable and a contact lens holder which is nonobtrusive and will not detract from the appearance of its environment.

SUMMARY OF THE INVENTION

The present invention pertains to a contact lens holder. The contact lens holder comprises a fixture shaped in the form of a creature having two eye sockets. The contact lens holder is also comprised of at least two containers, each of which hold a contact lens in a liquid solution. The containers are in contact with and disposed in the creature's eye sockets such that the containers represent the creature's eye. In a preferred embodiment, the containers are releasably secured to the fixture.

BRIEF DESCRIPTION OF THE DRAWINGS

In the accompanying drawings, the preferred embodiment of the invention and preferred methods of practicing the invention are illustrated in which:

FIG. 2*b* is a front view of a contact lens holder.

DESCRIPTION OF THE PREFERRED EMBODIMENT

Figure 1B:
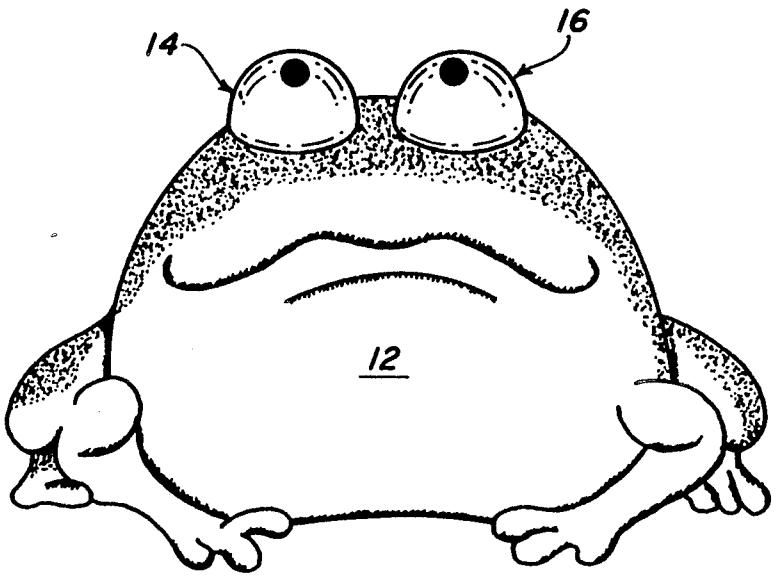
FIG. 1*a* is a side view of a contact lens holder.
Figure 1A:
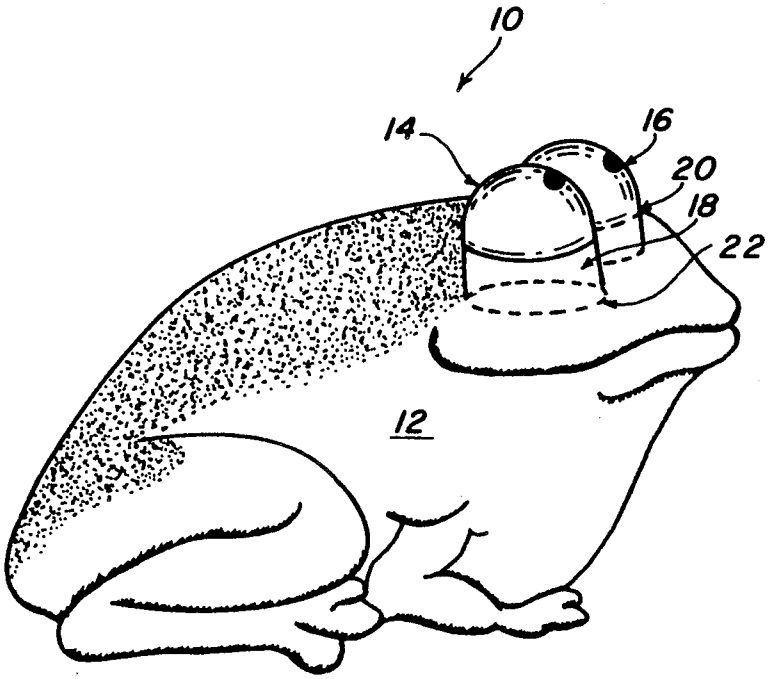

Referring now to the drawings wherein like reference numerals refer to similar or identical parts throughout the several views, and more specifically to FIG. 1*a* thereof, there is shown a contact lens holder 10. The holder 10 comprises a fixture 12 and at least two containers 14, 16, each for holding a contact lens (not shown). The holder also comprises means 18 for releasably securing the container 14, 16 to the fixture 12. Preferably, the fixture 12 is shaped in the form of a creature, such as a happy frog, and wherein the securing means 18 are disposed in the eye sockets 20, 22 of the creature such that the containers 14, 16 when secured to the creature represent the creature's eyes.

Figure 2:
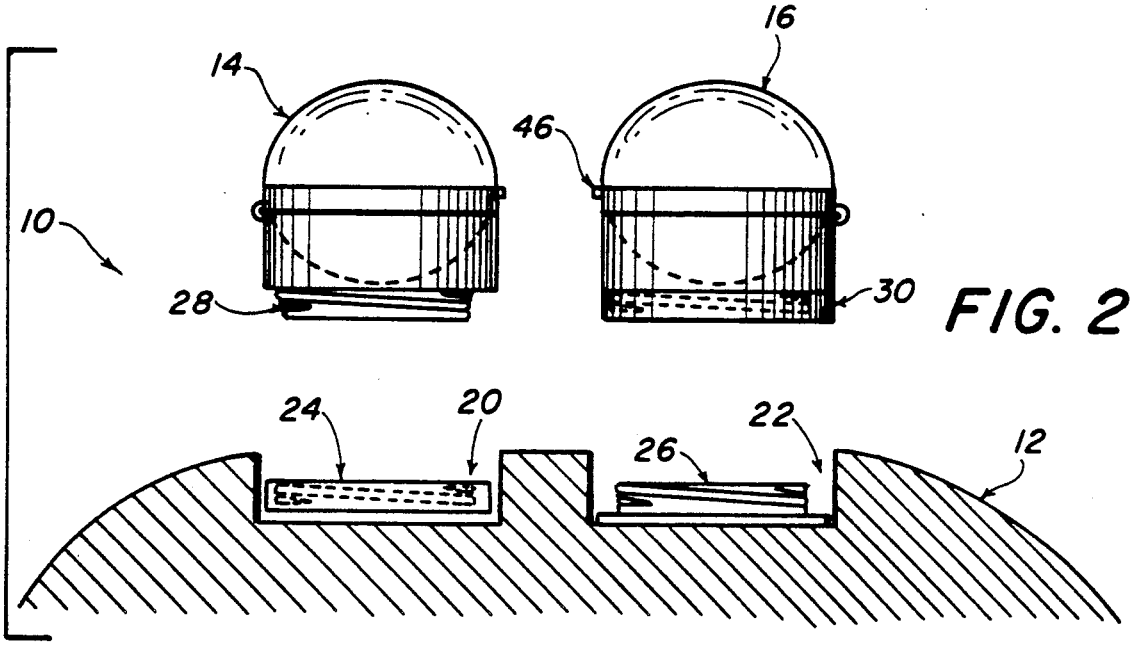
FIG. 2 is a schematic representation of contact lens containers in juxtaposition with a portion of the contact lens holder.

As shown in FIG. 2, the securing means 18 preferably comprises at least two threaded elements 24, 26 disposed on the fixture 12 and a threaded portion 28, 30 disposed on each of the containers 14, 16 for engaging with one of the threaded elements 24, 26. Preferably, the threaded element 24 has female threads and the threaded element 26 has male threads. Accordingly, the container 14 has a threaded portion 28 having male threads for engaging with the female threaded element 26. In a similarly manner, container 16 has a threaded portion 30 with female threads for engaging with the male threaded element 28.

Figure 3:
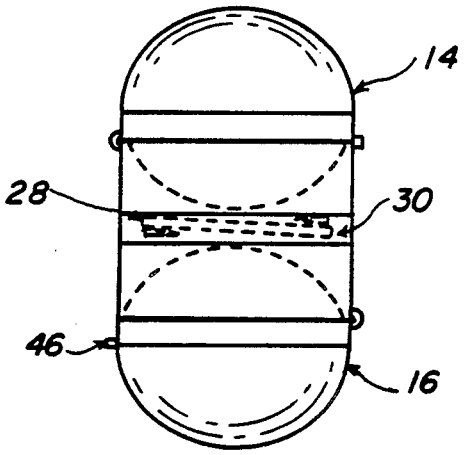
FIG. 3 is a schematic representation of the contact lens containers.

Preferably, as shown in FIG. 3, the male threaded portion 28 can threadingly engage with the female threaded portion 30 for securing the containers 14, 16 together. Thus, the containers 14, 16 can be unscrewed from the fixture 12 and screwed to themselves for convenient transport.

Figure 4:
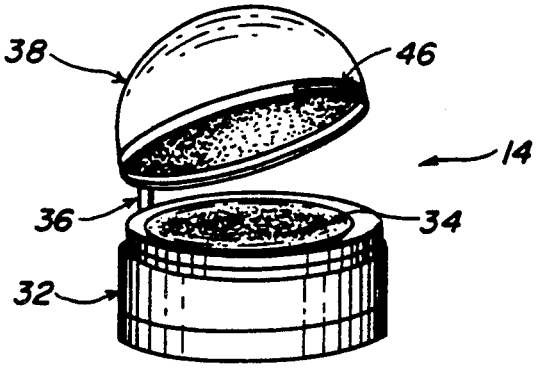
FIG. 4 is a schematic representation of a contact lens container which is opened.

In a preferred embodiment and as shown in FIG. 4, each container 14, 16 comprises a storage well 32 for holding the contact lens 34 in a bath of liquid solution 36 and a lid 38 for sealably covering the storage well 32. Preferably, the lid 38 is of the snap-on type and is joined to the storage well 32 with a hinge 40.

Figure 5:
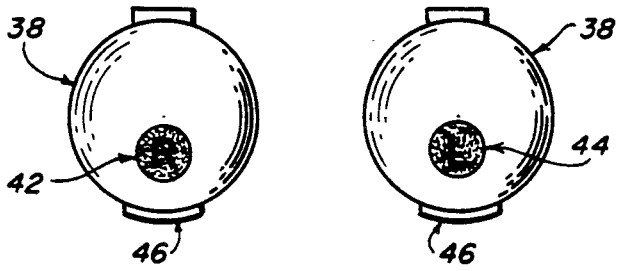
FIG. 5 is a schematic representation of contact lens containers having indicia thereon.
Figure 6:
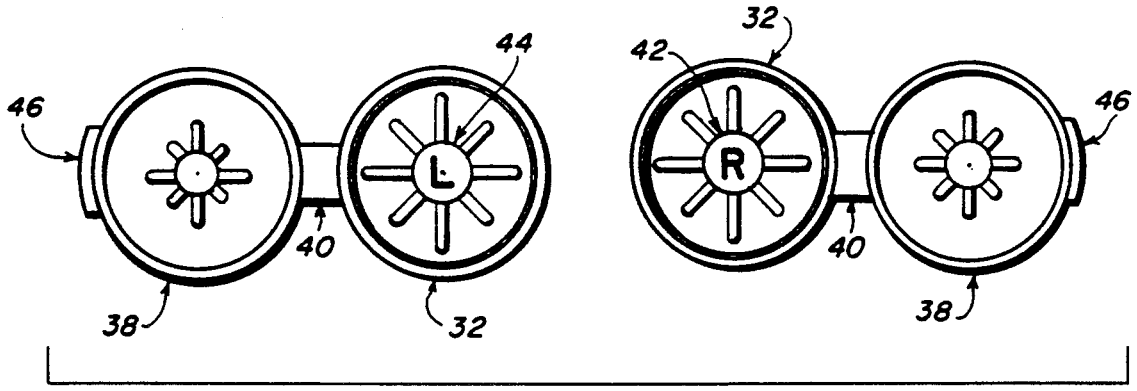
FIG. 6 is an overhead view of two contact lens containers which ar opened.

As shown in FIG. 5, preferably, indicia 42 representing the letter R is disposed on one of the lids 38 and indicia 44 representing the letter L is disposed on another one of the lids 38. This allows the contact lens wearer to easily identify the appropriate container 14, 16. Preferably, as shown in FIG. 6, the storage well 32 having the lid 38 with the letter R also has indicia 42 representing the letter R disposed thereon. In a similar manner, the storage well 32 having the lid 38 with the letter L has disposed on it has indicia 44 representing the letter L. Thus, when the lid 38 is open, the contact lens wearer can still identify the appropriate container 14, 16 by looking in the storage well 32. Preferably, the indicia 42, 44 comprises raised lettering.

The operating procedure for the contact lens holder 10 begins with placing the fixture 12 with containers 14, 16 secured in the eye sockets 20, 22 on an accessible surface such as a bathroom sink. Container 14 is opened by placing the user's thumb or index finger on a tab 46 located on front of the lid 38 and pushing upward to release the lid 38 from the storage well 32. The hinge 40 allows the lid 38 to expose the storage well 32 while still being attached to it. Container 16 is then opened in a similar manner. The storage well 32 of each container 14 and 16 is then filled with a preferred liquid solution 36, such as saline. Next, the right contact lens of the user is placed in the storage well 32 of container 14. Both the lid 38 and storage well 32 of container 14 have raised lettering representing the letter R for easy identification. In a similar manner, the left contact lens of the user is placed in the storage well 32 of container 16 which has raised lettering representing the letter L. The lid 38 of container 16 also has raised lettering representing the letter L. Once the contact lenses of the user have settled to the bottom of their respective storage well 32 in the liquid solution 36. The lid 38 of each container 14, 16 is then closed by pushing the lid 38 to snap it onto its respective container 14, 16. The contact lenses are now properly stored. The fixture being substantial and identifiable will not be easily brushed aside or lost and the containers 14, 16, being fixedly secured to the fixture, can now be easily located. If it is desired, the containers 14, 16 can be unscrewed from the threaded elements 24, 26 of the fixture 12 and the threaded portions 28, 30 screwed to themselves for convenient transport of the containers apart from the fixture 12.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A contact lens holder comprising:

a fixture shaped in the form of a creature having two eye sockets; and at least two containers, each of which holds a contact lens in a liquid solution, said containers in contact with and disposed in the creature's eye sockets such that the containers represent the creature's eyes.

2. A contact lens holder as described in claim 1 including means for releasably securing the containers to the fixture.

3. A contact lens holder as described in claim 2 wherein the securing means comprises at least two threaded elements disposed on the fixture and a threaded portion disposed on each of the containers for engaging with one of the threaded elements of the fixture.

4. A contact lens holder as described in claim 3 wherein one of the threaded elements has female threads, one of the threaded elements has male threads, one of the containers has a threaded portion which has male threads for engaging with the threaded element of the fixture having female threads and one of the containers has a threaded portion which has female threads for engaging with the threaded element of the fixture with male threads.

5. A contact lens holder as described in claim 4 wherein the threaded portion of the container having male threads can threadingly engage with the threaded portion of the container having female threads for securing the containers together.

6. A contact lens holder as described in claim 1 wherein each container is comprised of a storage well for holding the contact lens in the liquid solution and a lid for sealably covering the storage well.

7. A contact lens holder as described in claim 6 wherein the lid is a snap-on lid.

8. A contact lens holder as described in claim 7 wherein the lid is joined to the storage well with a hinge.

9. A contact lens holder as described in claim 8 wherein indicia representing the letter R is disposed on one of the lids and indicia representing letter L is disposed on another one of the lids.

10. A contact lens holder as described in claim 9 wherein the storage well corresponding to the lid having indicia representing the letter R has indicia representing the letter R thereon and the storage well corresponding to the lid having indicia representing the letter L has indicia representing the letter L thereon.

11. A contact lens holder as described in claim 10 wherein the indicia representing the letter R and the letter L on the containers are comprised of raised lettering.

12. A contact lens holder as described in claim 11 wherein the securing means comprises at least two threaded elements disposed on the fixture and a threaded portion disposed on each of the containers for engaging with one of the threaded elements of the fixture.

13. A contact lens holder as described in claim 12 wherein one of the threaded elements has female threads, one of the threaded elements has male threads, one of the containers has a threaded portion which has male threads for engaging with the threaded element of the fixture having female threads and one of the containers has a threaded portion which has female threads for engaging with the threaded element of the fixture with male threads.

14. A contact lens holder as described in claim 13 wherein the threaded portion of the container having male threads can threadingly engage with the threaded portion of the container having female threads for securing the containers together.

15. A contact lens holder as described in claim 14 wherein the threaded elements are fixedly attached to the fixture.

16. A contact lens holder as described in claim 15 wherein each lid is in the shape of a semi-sphere.

* * * * *